United States Patent [19]

Chambers et al.

[11] Patent Number: 4,577,179

[45] Date of Patent: Mar. 18, 1986

[54] PROGRAMMER/TIMER FOR APPLIANCES

[75] Inventors: Worthy L. Chambers, Lombard; William H. Jones, Villa Park; Arthur H. Hayden, Crystal Lake, all of Ill.

[73] Assignee: Eaton Corporation, Cleveland, Ohio

[21] Appl. No.: 367,867

[22] Filed: Apr. 15, 1982

[51] Int. Cl.[4] ..... G08B 1/00; H01H 7/08

[52] U.S. Cl. ..... 340/309.15; 200/38 R; 200/35 R; 200/39 R

[58] Field of Search ..... 340/309.15, 309.4, 309.5; 307/140, 141; 74/116, 118, 122, 125, 568 T, 154; 200/38 R, 38 B, 38 FA, 38 BA, 38 CA, 35 R, 39 R, 30 R; 310/68 R, 69

[56] References Cited

U.S. PATENT DOCUMENTS

| | | | |
|---|---|---|---|
| 3,015,003 | 12/1961 | Simmons | 74/3.5 |
| 3,033,999 | 5/1962 | Thornbery et al. | 137/624.2 |
| 3,248,867 | 5/1966 | Jepson et al. . | |
| 3,262,110 | 7/1966 | Gardes . | |
| 3,395,585 | 8/1968 | Obermann . | |
| 3,440,813 | 4/1969 | Kolodziej . | |
| 3,540,029 | 11/1970 | Bassett . | |
| 3,601,973 | 8/1971 | Bassett et al. . | |
| 3,603,749 | 6/1970 | Davis . | |
| 3,626,117 | 12/1971 | Stafford . | |
| 3,650,157 | 3/1972 | Strathearn et al. . | |
| 3,651,701 | 3/1972 | Holzer et al. | 74/143 |
| 3,664,198 | 5/1972 | Chestnut et al. | 74/112 |
| 3,678,769 | 7/1972 | Holzer | 74/118 |
| 3,694,591 | 9/1972 | Bassett et al. . | |
| 3,724,248 | 4/1973 | Obermann . | |
| 3,737,598 | 6/1973 | Kudoh et al. | 200/38 R |
| 3,871,238 | 3/1975 | Kitai | 74/112 |
| 3,914,951 | 10/1975 | Heidorn . | |
| 3,961,327 | 6/1976 | Kloenne et al. . | |
| 4,179,945 | 12/1979 | Obermann . | |
| 4,250,420 | 2/1981 | Grah et al. | 200/38 B |
| 4,467,664 | 8/1984 | Willigman et al. | 200/38 B |

FOREIGN PATENT DOCUMENTS 2040464 8/1970 Fed. Rep. of Germany .

*Primary Examiner*—John W. Caldwell, Sr.
*Assistant Examiner*—Tyrone Queen
*Attorney, Agent, or Firm*—C. H. Grace; R. A. Johnston

[57] ABSTRACT

A programmer timer (10) having motor driven cams (61, 64, 62, 66) for operating electrical switching mechanisms (102, 116, 144, 138, 126). The motor comprises a pair of spaced stator plates (24, 26) with a coil (34) and permanent magnet rotor (36) therebetween, received in a walled chamber (28) in the timer housing. Motor reduction gears (44) drive a shaft (48) for driving the ratchet wheels (72, 68) and rotary cams. The motor, gear train cams and electrical switching mechanisms are contained in a single integral housing (12). Separate concentric fast and slow ratchet wheels (72, 68) are driven by a single eccentric driven pawl (14). The center of rotation of the eccentric is positioned so that drive pawl contacts the ratchet wheel at an angle at least 10° greater than a tangent at the contact point, for all eccentric positions, to provide ratchet wheel advance in the event of reverse rotation of the eccentric. A bifurcated anti-reverse pawl (84) is biased against the fast and slow ratchet wheels by a spring arm (88) integral therewith. The center of rotation of the eccentric is spaced from the fast and slow ratchet wheel centers and optionally has a subinterval cam (148) provided thereon for affecting switching. The anti-reverse pawl may optionally be pivoted about the center of rotation of the drive eccentric. The motor stator plates optionally include integrally therewith a striker arm (178, 180) and anvil (176) for cam controlled operation of a buzzer. The ratchet drive pawl alternatively is biased by a spring arm (154) formed integrally therewith. The ratchet wheel may also optionally employ wiper contacts (200) for contacting a stationary printed circuit board.

5 Claims, 15 Drawing Figures

Fig. 5
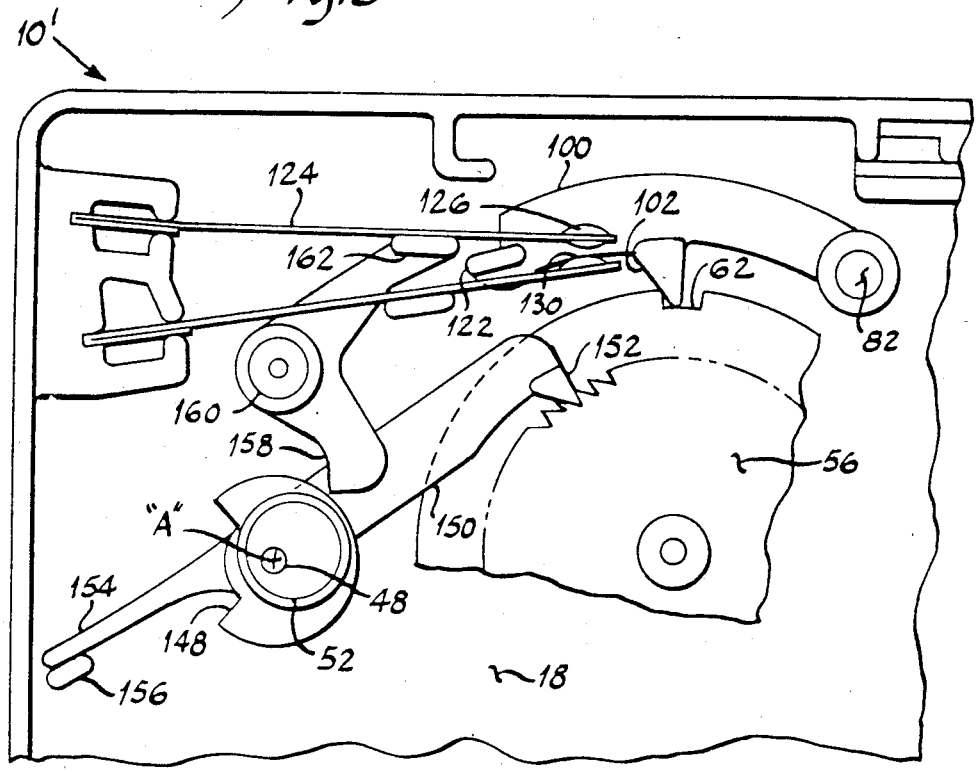
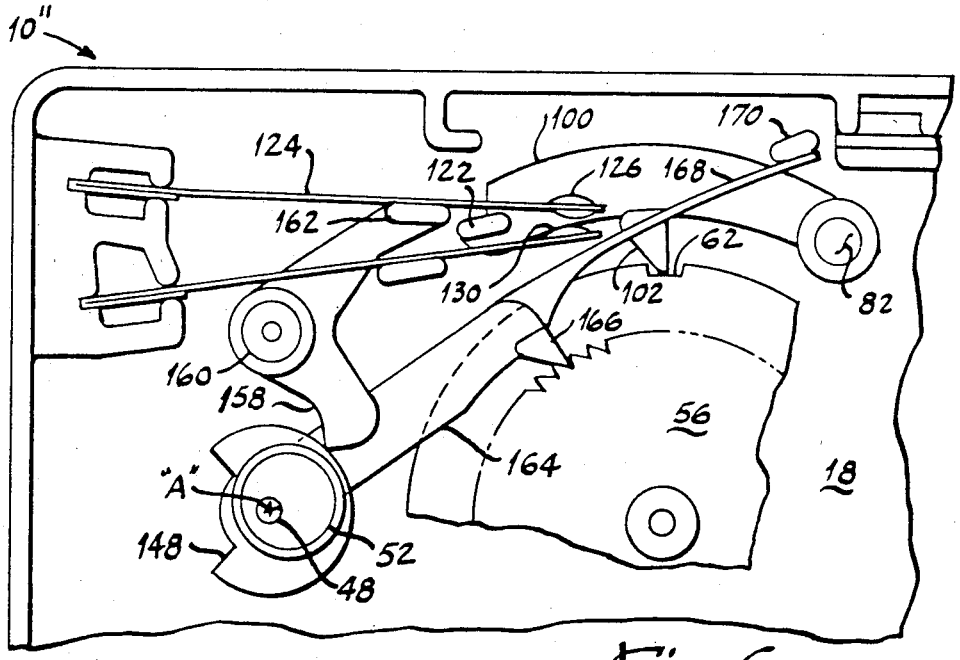
Fig. 6

Fig. 7
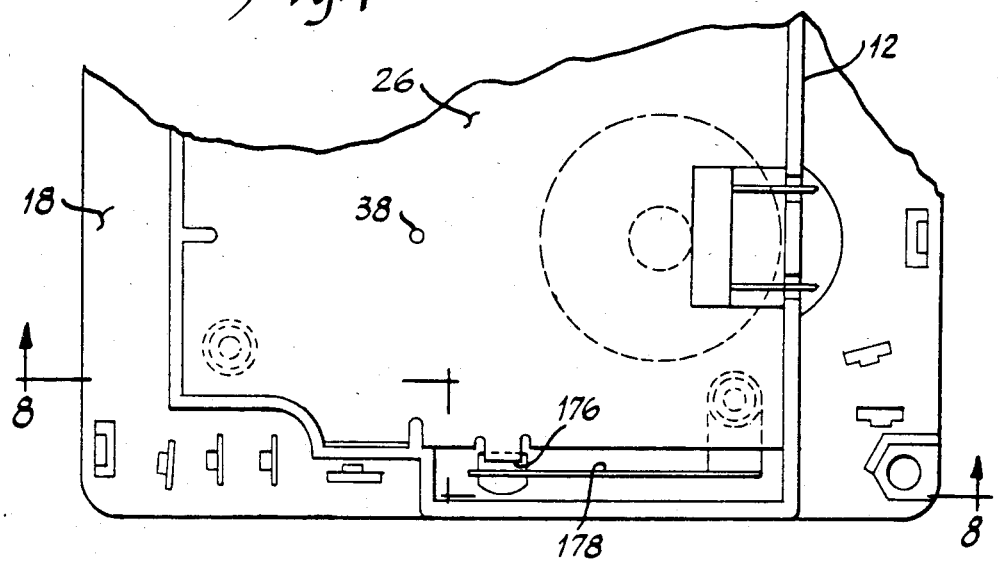
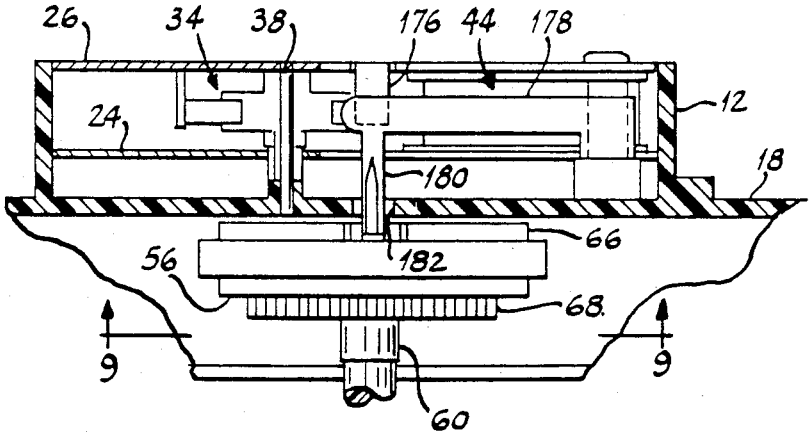
Fig. 8

PROGRAMMER/TIMER FOR APPLIANCES

BACKGROUND OF THE INVENTION

The present invention relates to programmer timers for appliances such as dishwashers, clothes washers, and clothes driers. Appliances of this type commonly utilize a synchronous timing motor to drive a cam mechanism for actuating a plurality of cam follower actuated switches for making and breaking individual electrical circuits for various control functions of the appliance. Programmer-timers of this type operate to control the appliance function in timed sequence and duration for providing a preselected program cycle of appliance operation.

It is known to provide appliance programmer timers having a plurality of rotary cams mounted for rotation about a common axis with the cam being rotationally advanced by a stepping mechanism. In programmer/-timers of this known type, ratchet wheels are provided for advancing the rotary cams and a motor driven oscillating pawl engages the ratchet wheel for step-by-step advancement of the cam. The advance pawl may be driven by a rotating eccentric or crankshaft attached to a suitable gear reduction mechanism driven by the synchronous timing motor.

Known programmer/timers employing a synchronous timing motor have employed a ratchet mechanism in the synchronous motor to prevent reverse rotation startup of the motor which is an inherent feature of a synchronous motor. This antireverse feature in the motor has been necessitated in order to prevent reverse rotation of the drive mechanism for the ratchet advance pawl. Where the ratchet advance pawl is driven by a rotating crank or eccentric, reverse rotation of the eccentric has caused the drive pawl to "kick out" or disengage from the ratchet teeth and thereby malfunction in advancing the cam.

In programmer/timers for appliances, it is known to provide axially adjacent ratchet wheels having different pitch diameters for the peripheral teeth thereof but utilize the same pitch for the teeth of both wheels in order that a single drive pawl may actuate both ratchet wheels. It is also known to provide an intermittent series of deeper notches on one ratchet wheel to permit the drive pawl to periodically advance the first and second ratchet wheels together for a single step. This arrangement provides for faster advancement of the cam attached to the ratchet having the greater tooth pitch diameter than the cam attached to the second ratchet wheel.

Moreover, it has been desired to provide a programmer timer having a convenient low cost means for providing actuation of a separate cam follower at sub-intervals of advancement of the main ratchet wheel. Sub-interval cam follower actuation may then be employed to modify the actuation of a set of contacts actuated by either the fast or slow cam wheel or to actuate a separate set of electrical contacts.

Appliance programmer/timers have heretofor employed a separate timing motor attached to a housing which contained the escapement, cams, cam followers and electrical contacts. The gear reduction mechanism for driving the escapement has heretofore usually been incorporated in the separate motor housing. This arrangement permits separate assembly of the motor and timer mechanism; however, such an arrangement has the disadvantage of increased cost associated with separate housings for the motor and the timer mechanism.

Thus, it has been desired to provide an appliance programmer timer having a synchronous motor driven cam advance mechanism which eliminates the need for an anti-reverse directional ratchet mechanism on the timing motor and accommodates rotation of the timing motor in either direction without malfunction of the escapement. It has further been desired to provide a low cost programmer timer with the motor and timer assembled as a unit in an integral housing thereby eliminating the need for separate motor and timer housings. It has further been desired to provide a simple and low cost programmer timer having a sub-interval timed electrical switching function with relation to the timing interval employed by the main switching sequence.

SUMMARY OF THE INVENTION

The present invention provides an appliance programmer timer having an escapement driven by a synchronous motor for advancing a rotary cam having a follower for actuating a set of electrical contacts to perform a switching function. The present invention employs an eccentric driven advance pawl contacting a ratchet wheel connected to the rotary cam for providing step-by-step advancement of the cam. The axis of rotation of the eccentric is spaced from the axis of rotation of the cam and has mounted for rotation therewith a sub-interval cam. A separate cam follower is responsive to rotation of the sub-interval cam to alter the movement of the electrical contacts or, alternatively, actuate a separate set of electrical contacts.

The programmer timer of the present invention employs a unique integral timer-motor housing wherein the motor comprises a pair of spaced parallel stator plates received in a walled cavity in the housing and registered for alignment therein with the motor coil and rotor disposed between the parallel stator plates. The present invention employs the motor described in copending application Ser. No. 260,626 filed May 5, 1981 entitled "Synchronous Motor", now abandoned, and assigned to the assignee of the present invention. The housing in one embodiment of this arrangement has a deck, or wall, portion separating the motor for the gear reduction, cams, escapement, cam followers and electrical contacts. The arrangement thus permits assembly of the motor on one side of the housing and assembly of the escapement, cams and contacts on the other side of the housing to thereby provide a unified assembly of the programmer timer and minimize manufacturing costs. An alternate embodiment of the integral housing for the motor and timer permits the motor, cams, contacts and escapement to be assembled from one side of the housing.

The cam advance escapement in the present invention employs an eccentric driven pawl which engages the ratchet wheel or wheels such that the direction of motion of the pawl forms an angle with the tangent to the ratchet, at the point of contact, of not less than 10°. This arrangement of the pawl and ratchet permits the pawl to advance the ratchet wheel normally even if the eccentric pawl drive mechanism is rotated in a reverse manner by synchronous timing motor.

The present invention thus provides a unique and low cost programmer timer having a novel means for providing timed interval switching functions and sub-interval switching functions and accommodates forward and reverse rotation of a synchronous timing motor without malfunction. The present invention also employs a unique arrangement of the synchronous timing motor and timer housing to permit assembly of the motor and timer mechanism in a unified housing arrangement.

The cam advance mechanism of the present invention employs a unique anti-reverse pawl biased against the cam advance ratches by an integral spring finger. The present invention optionally employs a unique integral spring-ratchet pawl for preventing the operator from manually reversing the cam and advance ratchet during program selection. The escapement of the present invention optionally employs a ratchet advance pawl having an integral spring finger for biasing the pawl against the ratchet. Another optional feature provides a unique alarm buzzer formed integrally with the motor stator plates.

A BRIEF DESCRIPTION OF THE DRAWINGS

FIG. 5 is a portion of a view similar to FIG. 1 and shows an alternate embodiment of the escapement;

FIG. 6 is a portion of a view similar to FIG. 1 and shows another embodiment of the escapement;

FIG. 7 is a portion of a view taken along section-indicting lines 7—7 of FIG. 4 and shows the optional buzzer;

FIG. 8 is a partial view taken along section-indicating lines 8—8 of FIG. 7;

DETAILED DESCRIPTION

Figure 1:
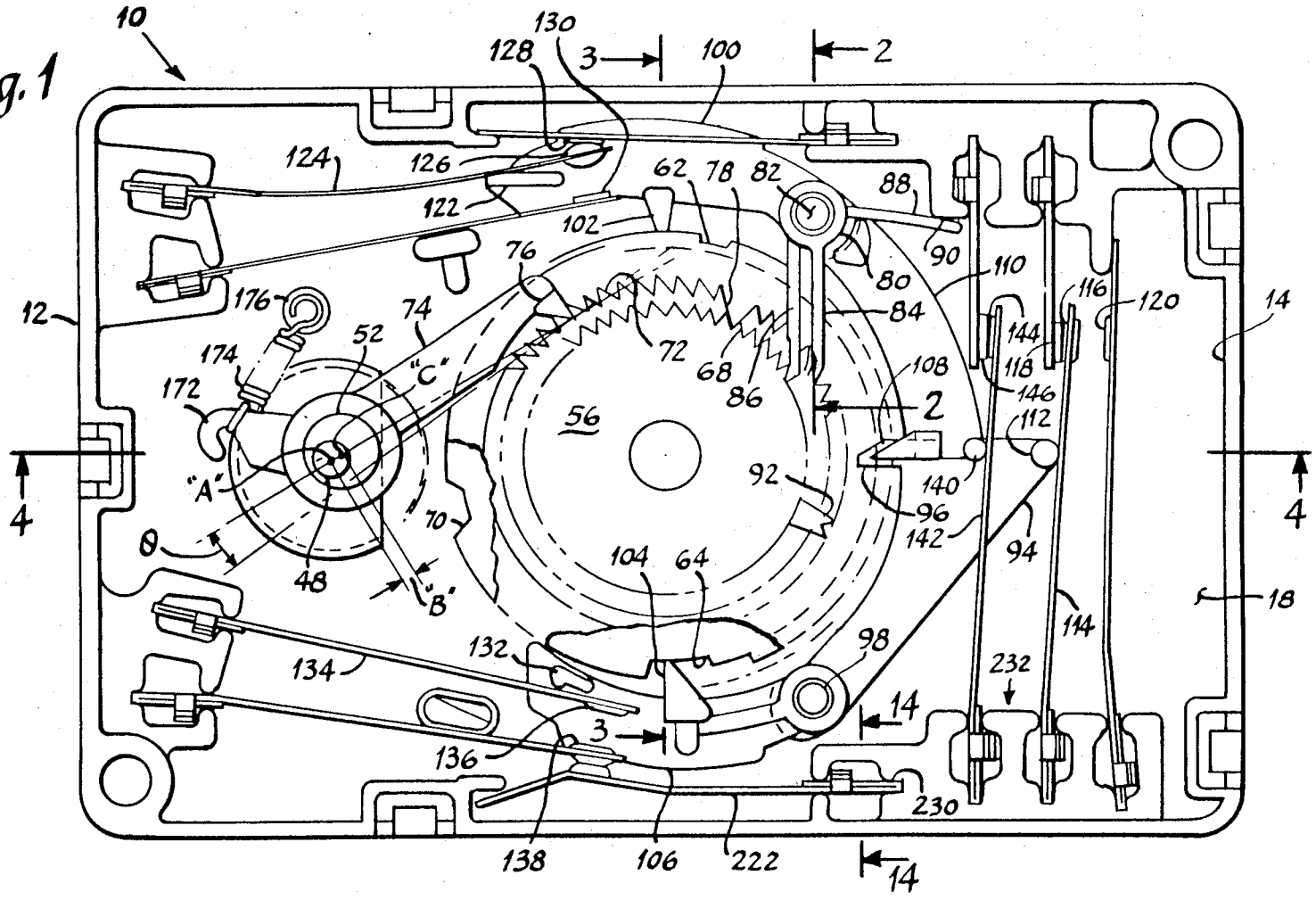
FIG. 1 is a plan view of the programmer/timer of the present invention with the housing cover removed for purposes of illustration.

Referring now to FIGS. 1, 2, 3 and 4, the programmer timer of the present invention is indicated generally at 10 as having a housing 12 having formed integrally therewith (see FIG. 4) a timer cavity 14 and a motor cavity 16 which are separated by a dividing wall portion 18. The timer cavity 14 has a cover plate 20 received thereover and retained by a suitable means, such as snap locks 22, formed integrally with the housing 12. The timer cavity 14 is shown in plan view in FIG. 1 with the cover plate 20 omitted for clarity.

The motor cavity 16 has received therein a pair of spaced motor stator plates 24, 26 which are registered against the inner periphery of the cavity wall 28 and received over a plurality of shouldered posts shown typically at 30. The stator plates are retained thereon by suitable fasteners such as clips 32. A motor coil assembly, indicated generally at 34, is received between the stator plates in side-by-side relationship with a permanent magnet rotor assembly, indicated generally at 36, having axle pin 38 journaled at its upper end in housing wall 18 and in stator plate 26 at its lower end. A plurality of interdigitated stator poles 40 are formed integrally in the stator plates and surround the rotor assembly. A suitable ferromagnetic core 42 is provided for completing the flux path between the stator plates to permit synchronous operation of the motor.

Stator plate 24 is spaced from the housing wall 18 by an amount suitable to permit the incorporation of a gear train, indicated generally at 44, which is driven by rotor pinion 46 which extends through an aperture in stator plate 24 and is attached to the rotor 36. The output of the gear train 44 is through shaft 48 journaled for rotation on a post 50 formed on the housing wall 18 which post 50 extends upward into timer cavity 14. Shaft 48 has an eccentric 52 provided thereon and has its upper end journaled for rotation in aperture 54 provided in the housing cover 20.

A timer cam wheel 56 is received in timer cavity 14 and has a stub shaft 58 journaled in an aperture formed in housing wall 18 and spaced from the center of rotation of shaft 48. Wheel 56 also has a shaft 60 extending therefrom in a direction opposite stub shaft 58 and through an aperture in housing cover 20. Shaft 60 is adapted for manual rotation by the appliance operator for suitable cycle program selection. In the presently preferred practice wheel 52 has a plurality of peripheral cam tracks 61, 64 and 66 provided thereon and has concentric therewith and axially adjacent a toothed ratchet surface 68 provided about the periphery thereof. A second ratchet wheel 70 is received over shaft 60 for free rotation with respect to wheel 56 and wheel 70 also has a toothed ratchet surface 72 provided about the periphery thereof.

Eccentric 52 has one end of a drive pawl 74 received thereover for reciprocal (orbital) movement thereof upon rotation of shaft 48. The free end of pawl 74 has a ratchet engaging tooth 76 provided thereon which tooth is sufficient in width to engage both ratchet 68 and ratchet 72.

Referring in particular to FIG. 1, the teeth of ratchet 72 has a pitch diameter slightly larger than ratchet 68. In the presently preferred practice ratchet 72 intermittently contains a deep notch 78 at a desired interval, or multiple or teeth, such that upon the pawl tooth 76 engaging the deep notch, pawl 74 drops to a position whereupon the ratchet tooth 76 engages simultaneously ratchet 72 and ratchet 68 to thereby index both ratchet wheels together for a single stroke. Thus, the single pawl 74 provides continuous indexing of wheel 70 and intermittent indexing of wheel 56, dependent upon the number and spacing of deep notches provided in ratchet 72.

With continuing reference to FIG. 1, gear box output shaft 48 rotates about a center of rotation "A" and eccentric 52 is eccentric to point "A". In the presently preferred practice, the eccentric drive surface 52 is formed by a circular surface on shaft 48 having a center of rotation "C" displaced from shaft center "A" by an amount equal to the dimension "B". The indexing mechanism thus yields a longitudinal stroke for pawl 74 equal to twice the amount of "B".

In order for the drive pawl 74 to function properly, irrespective of the direction of rotation of eccentric 52, it is necessary that the angle of contact of drive pawl 74 with the ratchets 72, 68 be greater than a tangent angle to the ratchet at the point of contact of pawl tooth 76. This is illustrated in FIG. 1 wherein a line through the center of excursion "C" of eccentric 52 is shown to make an angle 0 with the tangent to the ratchet at the point of contact of pawl tooth 76.

In order to prevent pawl tooth 76 from disengaging or "kicking out" of the teeth of the ratchet, for all positions of center of excursion "C" of eccentric 52, it is necessary that the angle 0 be approximately 10 degrees or greater. This means that for all positions of center of excursion "C" as eccentric 52 rotates either clockwise or counterclockwise, a line through center "C" and the point of contact of pawl tooth 76 with the ratchet must make an angle of at least 100 degrees with a radius to the ratchet at the point of tooth contact. The "bite" of pawl tooth 76 is maximized when the driving stroke occurs with center of excursion "C" of eccentric 52 above the center of rotation "A" of shaft 48, as viewed in FIG. 1.

The arrangement for the indexing mechanism shown in FIG. 1 gives the pawl tooth 76 sufficient "bite" on the ratchet teeth to prevent malfunction of pawl 74 in the event of counterclockwise rotation of eccentric 52, it being understood that in normal operation eccentric 52 rotates in a clockwise direction as viewed in FIG. 1 in order to maximize the "bite" of the pawl tooth 76.

Figure 2:
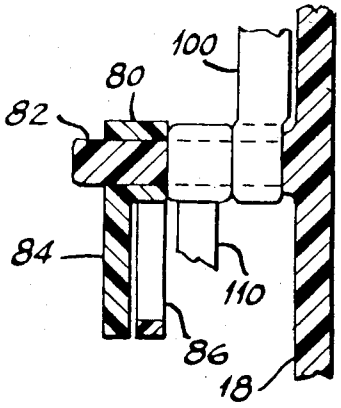
FIG. 2 is a section view taken along section-indicating lines 2—2 of FIG. 1.

Referring now to FIGS. 1 and 2, an antireverse pawl having hub 80 is pivotally received over a mounting post 82 extending from the wall 18 of the timer housing. Pawl 80 has a pair of generally parallel spaced fingers 84, 86 extending from the hub thereof with pawl 84 contacting a larger diameter ratchet 72 and finger 86 contacting smaller ratchet 68 such that any attempt to rotate the ratchets counterclockwise as shown in FIG. 1 would be resisted by the "bite" of the fingers 84, 86 sufficient to prevent counterclockwise rotation of the ratchet.

Pawl 80 has a third finger 88 formed integrally with the hub 80 and extending rightwardly in FIG. 1 which registers against a shouldered portion 90 provided integrally in the housing wall 18. In the presently preferred practice, the pawl finger 88 is formed of resilient material such that it comprises a spring preloaded against lug 90 to provide torque on pawl hub 80 to thereby bias the pawl fingers 84, 86 into contact with ratchets 68, 72. It will be understood however to those skilled in the art that although pawl finger 88 is formed of rigid material in the embodiment described, fingers 84, 86 may alternatively be formed of resilient material to thereby provide a preload of the fingers against the ratchet teeth.

Alternatively, as will hereinafter be described, antireverse pawl 80 may be pivotally mounted about the center of rotation "A" of drive shaft 48 to give the antireverse pawl and the main drive pawl 74 a common reference point for attacking the ratchet teeth. Functionally, this alternate arrangement facilitates varying the stroke of the advance pawl 74 and yet permits the antireverse pawl to properly engage the ratchet teeth irrespective of the stroke of the advance pawl.

Referring again to FIG. 1, the slower or main ratchet 68 can optionally have a raised tooth portion 92 having the same tooth pitch and pitch diameter as the teeth of ratchet 72 such that, at a selected position on the program cam wheel 56, the drive pawl tooth 76 engages raised tooth 92 to provide a single one-step advance of the wheel 56 at a position separate from the deep notches 78.

Figure 3:
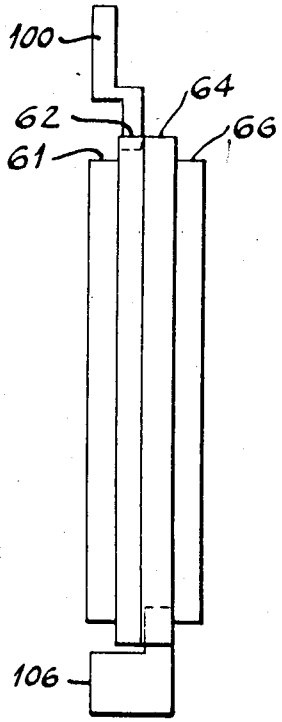
FIG. 3 is a view taken along section-indicating lines 3—3 of FIG. 1.
Figure 4:
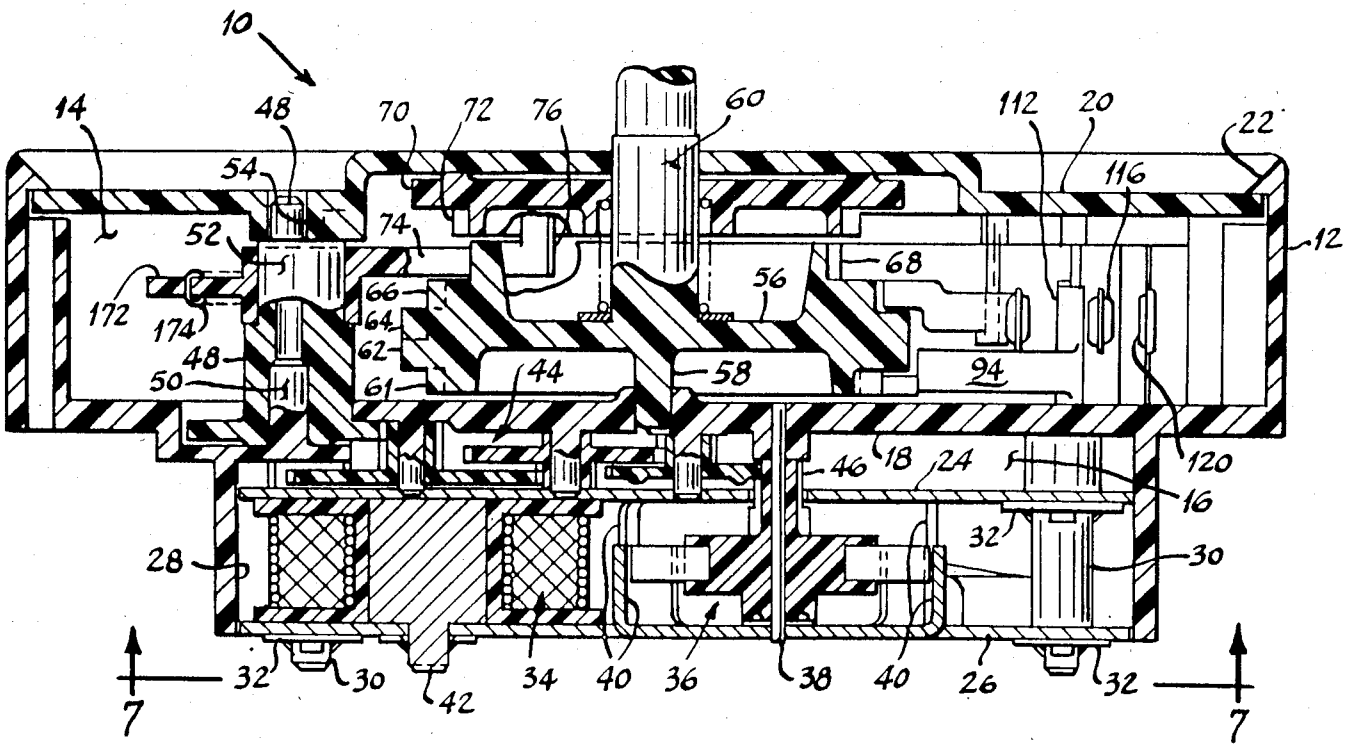
FIG. 4 is a section view taken along section-indicating lines 4—4 of FIG. 1 and shows the motor and gear reduction installed in the integral housing.

Referring now to FIGS. 1, 3 and 4, the main or slow ratchet wheel 56 has the cam track 61 thereof engaged by a cam follower 94 having a cam engaging tooth 96 and being pivotally mounted about a post 98 extending upwardly from the wall 18 of the timer housing. Track 62 of the cam wheel 56 is engaged by cam follower 100 having a cam engaging tooth 102 with the follower 100 pivoted about post 82 (see also FIG. 2). Cam track 64 is engaged by tooth 104 provided in cam follower 106 pivotally received over post 98. Cam track 66 is engaged by tooth 108 of cam follower 110 which is pivotally mounted about post 82 (see FIG. 2).

Cam follower 94 has formed integrally therewith a lug 112 operative to contact for movement an electrical switch contact arm 114 having a movable contact 116 provided thereon for alternately making and breaking a circuit with stationary contacts 118, 120.

Cam follower 100 has a lug 122 extending integrally therefrom which contacts a movable electrical switch arm 124 having a movable contact 126 provided thereon. Lug 122 is operative upon movement of the follower 100 to move contact 126 alternately between stationary contacts 128, 130 for making and breaking electrical contact therebetween as desired for the appliance cycle program.

Cam follower 106 has a lug 132 extending integrally therefrom which upon motion of follower 106 contacts a movable contact arm 134 having a movable contact 136 provided thereon for making and breaking electrical contact with a stationary contact 138.

Cam follower 110 has an integral lug 140 extending therefrom operative to contact a movable switch arm 142 having a movable contact 144 provided thereon for making and breaking an electrical circuit with stationary contact 146.

The programmer/timer of the present invention thus provides in the embodiment of FIGS. 1 and 4 a fast and slow ratchet operative to drive a main cam wheel 56 and a secondary cam surface 70 (see FIG. 4) attached to the fast ratchet 72. In the embodiment of FIG. 1, cam follower tooth 102 on cam follower 100 has sufficient width to ride the track of cam 70 on the fast ratchet wheel so as to be responsive to notches thereon for permitting contact of movable electrical contact 126 with stationary contact 130 as required by the appliance cycle program.

It will be understood to those skilled in the art however, that as between cam track 70 and cam track 62, the sequence of events and positioning contact 126 by contact of the cam follower lug 122 with arm 124 may vary as desired to provide numerous combinations. For example, movable contact 126 may generally be positioned intermediate contacts 128 and 130 by cam track 62 and operative thereby to intermediately make contact with stationary contact 130; and, responsive to cam track 70 on the fast ratchet wheel to make contact with contact 128 or to periodically make a circuit with stationary contact 130.

Alternatively, cam track 70 may be employed to make a circuit with stationary contact 130 and cam 62 may be employed only to make and break a circuit with contact 128. The particular choice of sequencing of contacts 126, 128 and 130 responsive to cam tracks 62 and 70 will be governed by the requirements of the program cycle of the particular appliance.

Referring now to FIG. 5, an alternate embodiment, indicated generally at 10', of the timer of FIG. 1 is shown wherein the shaft 48 about which eccentric 52 rotates, has an auxiliary cam track 148 provided thereon for rotation with shaft 48 about point "A". A drive pawl 150 has one end thereof received over eccentric 52 for orbital movement therewith and has a drive tooth 152 formed integrally therewith for engaging the ratchet on wheel 56. Pawl 150 has formed integrally therewith a resilient spring member 154 which extends from the pivot center "A" in a direction opposite of pawl 150; and, finger 154 is registered against a lug 156 provided integrally from housing wall 18. The finger 154 is preloaded by an amount to sufficient provide the necessary bias to maintain the drive pawl tooth 152 in engagement with the ratchet.

A cam follower 158 is pivotally mounted about a post 160 extending from the housing wall 18. Cam follower 158 has a portion extending from post 160 in a direction opposite the cam track 148 which portion has a lug 162 formed thereon for contacting the movable contact arm 124. In operation, as drive shaft 48 rotates, cam track 148 causes cam follower 158 to pivot which in turn causes lug 162 to move the contact 126 toward and away from stationary contact 130. The cam track 148 thus operates as a subinterval cam for movement of the movable electrical contact 126 with respect to the main interval operation of contact 126 by cam follower lug 122.

Referring now to FIG. 6, another alternate arrangement of the timer of FIG. 1 is indicated generally at 10" wherein a main drive pawl 164 is pivotally received over eccentric 52 which is driven by shaft 48 by rotation about pivot center "A" for orbital movement of the pawl 164. Integral drive tooth 166 on pawl 164 contacts the ratchet on wheel 56 for causing indexed movement thereon. Shaft 48 also has auxiliary cam 148 provided thereon for movement of cam follower 158 for effecting subinterval movement of contact 126 in similar fashion to the embodiment of FIG. 5.

In the embodiment of FIG. 6, the main drive pawl 164 preferably has an integral spring finger 168 extending outwardly from the end of drive pawl 164 containing ratchet contacting tooth 166. Spring finger 168 is registered against a stationary lug 170 extending from the wall 118 of the timer housing. The spring finger 168 is preloaded by a desired amount to provide suitable bias of the pawl tooth 166 into contact with the ratchet wheel.

Referring again to FIG. 1, a still further alternate embodiment of the stepping mechanism of the present invention is illustrated wherein the drive pawl 74 has an arm portion 172 extending therefrom in a direction angularly spaced from arm 74 with one end of a preload spring 174 connected thereto. The opposite end of spring 174 is anchored to a stationary post 176 extending from the wall 18 of the timer housing such that spring 174 is tensioned to provide a preload of pawl arm tooth 76 against the ratchet on wheel 56.

Figure 9:
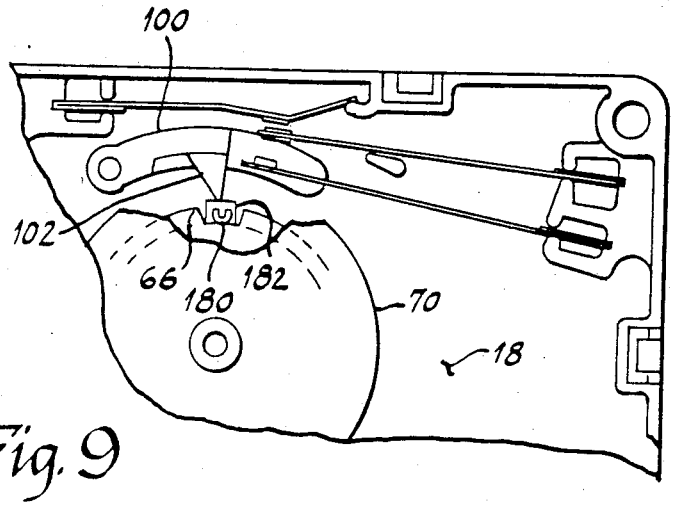
FIG. 9 is a partial view taken along section-indicating lines 9—9 of FIG. 8.

Referring now to FIGS. 7, 8 and 9, an optional buzzer is illustrated as formed integrally with the motor stator plates in the timer construction of the present invention.

As illustrated in FIG. 7 the outer stator plate 26 has formed integrally with one edge thereof an anvil 176; and, as shown in FIG. 8 a striker arm 178 is formed integrally with one edge of the opposite stator plate 24, with the striker 176 extending in the free position in spaced parallel arrangement with striker 178.

The striker arm 178 has a cam follower portion 180 formed preerably integrally therewith and extending therefrom through an aperture 182 formed in the wall 18 of the timer housing. The cam follower portion 180 makes contact with one of the cam tracks on main cam wheel 56 as for example, cam track 66.

In operation, when the cam track 66 releases cam follower 180 from a position biased away from anvil 176, the alternating current excitation of the magnetic field in stator plates 24, 26 causes the striker arm 178 to vibrate against anvil 176 thereby giving an audible alarm.

Figure 10:
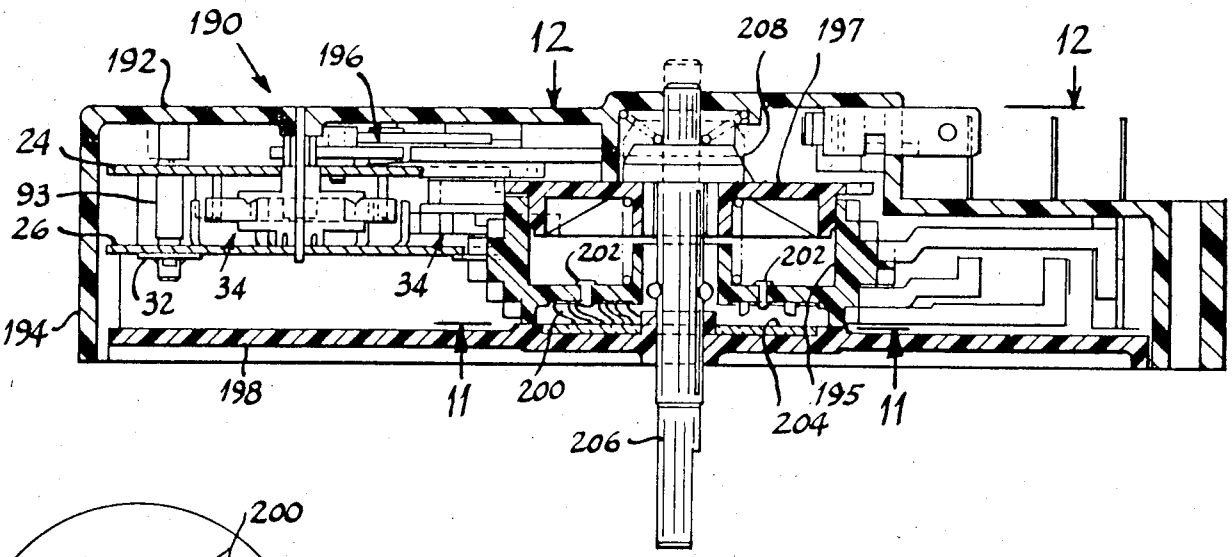
FIG. 10 is a partial view similar to FIG. 4 and illustrates an alternate embodiment employing a stationary printed circuit board having rotating wipers for auxiliary switching functions and an alternate housing arrangement for the motor and timer mechanism.

Referring now to FIG. 10, an alternate embodiment of the timer of FIG. 1 is indicated generally at 190 as having a unitary housing 192 having a deep-well configuration with wall 194 about the periphery thereof and open to one side. Motor plates 24, 26 are received therein in spaced parallel arrangement, with the rotor assembly indicated generally at 36 and coil assembly indicated generally at 34 received therebetween with the stator plates received over posts shown typically at 193 and retained thereon by clips 32.

In the embodiment of FIG. 10, the gear train indicated generally at 196 is assembled into the housing 192 for the opened side thereof, the motor stator plates, rotor and coil are assembled therein and the fast ratchet wheel 197 and slow or ratchet and wheel 195 containing the four main cam tracks are then assembled into the housing in side-by-side arrangement with the motor stator plates as shown in FIG. 10.

The escapement mechanism and contact arms are also assembled into the housing 192 from the open side thereof and a cover plate 198 is then secured thereover.

Figure 11:
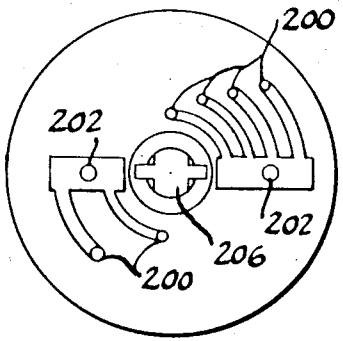
FIG. 11 is a partial view taken along section indicating lines 11—11 of FIG. 10.

Referring now to FIGS. 10 and 11, the main cam wheel has a plurality of rotating wiper arms 200 secured thereto by suitable fasteners such as rivets 202 and the wiper arms contact a stationary printed circuit board 204 secured to the inside of a cover plate 198. Thus the embodiment of FIG. 10 employs additional switching functions on the same cam wheel by incorporating rotating wipers for switching between contacts provided on a stationary printed circuit board. It will be understood however that alternatively, the printed circuit board 204 may be secured to the rotating cam wheel 195 and the wipers 200 may be secured in a stationary manner to the inside of housing cover plate 198.

Figure 12:
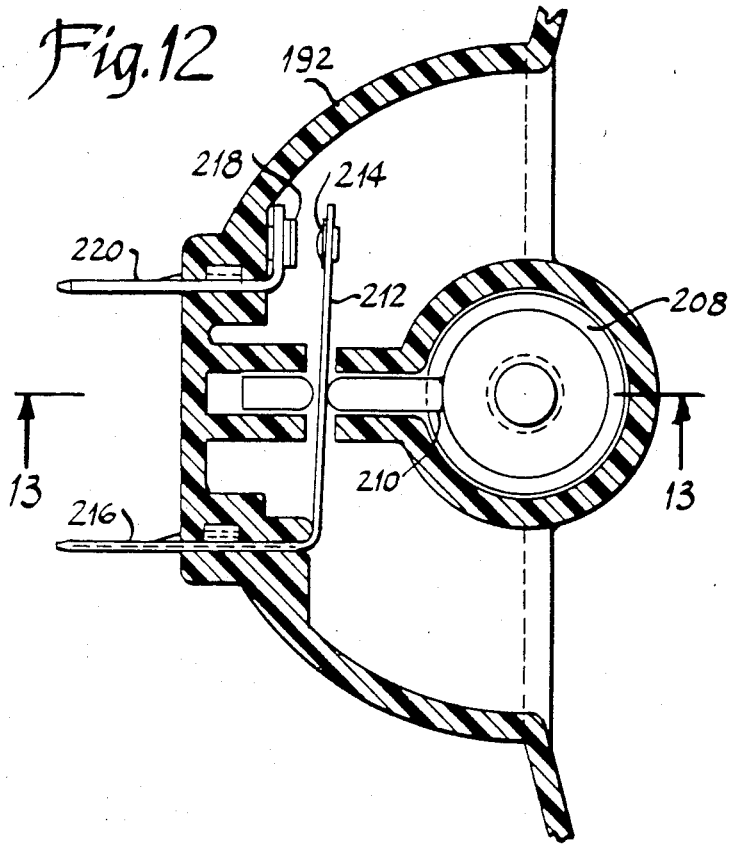
FIG. 12 is a partial plan view taken along section-indicating lines 12—12 of FIG. 10 illustrating an optional push-to-start switch feature.
Figure 13:
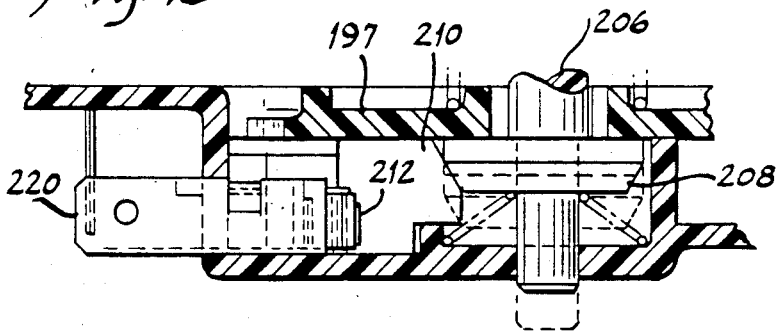
FIG. 13 is a partial view taken along section-indicating lines 13—13 of FIG. 12.

Referring now to FIGS. 10, 12 and 13, the push-to-start feature of the timer 190 is illustrated wherein the main shaft 206 for cam wheel 195 may be pushed axially by the appliance operator from the position shown in solid outline in FIGS. 10 and 13 to the position shown therein in dashed outline. The shaft 206 has a circular cam surface 208 provided thereon adjacent the end nearest the wall 192 of the housing and a slidable cam follower 210 is engaged by the cam surface 208. A movable contact arm 212 having a movable electrical contact 214 thereon registers against cam follower 210 and has the stationary end thereof connected to an electrical connecting terminal 216 which extends to the exterior of the housing.

A stationary electrical contact 218 is attached to one end of an electrical connecting terminal 220 which also extends through the wall 192 of the housing for external attachment thereto. In operation, as the shaft 206 is moved axially by the operator to the position indicated in dashed outline, cam surface 208 moves follower 210 which causes arm 212 to move stationary contact 214 to make electrical connection with contact 218 to complete the circuit to the power source for energizing machine operation.

By pushing the shaft 206 the appliance operator can complete the line power circuit irrespective of the position of the rotary cam wheel 195. Thus, the timer motor may be energized irrespective of the position of the electrical switching contacts associated with the cam wheel 195 and the cam wheel 197.

The embodiment of FIG. 10 permits assembly of the motor, gear train, stepping mechanism, rotary cams and ratchet wheels and cam followers and contacts all from one side of the timer housing without reversing the position of the timer housing during assembly. The additional advantage of the embodiment of FIG. 10 is that the gear train 196 may be assembled in the housing without the power output shaft thereof extending through the wall of the housing. The embodiment of FIG. 10 also eliminates the need for journaling one end of the output shaft in the cover of the timing housing as is the case in the embodiment of FIG. 4.

Figure 14:
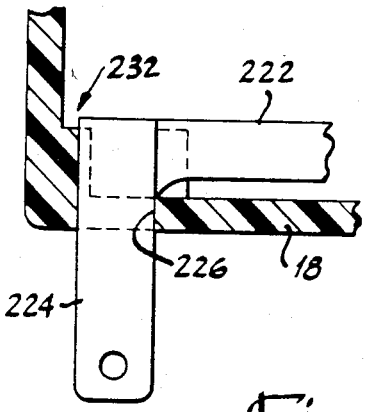
FIG. 14 is a partial section view taken along section-indicating lines 14—14 of FIG. 1.

Referring now to FIG. 14, the arrangement of a typical contact arm with integral electrical connecting terminals is shown, wherein a an arm portion 222 (see FIG. 1) has a folded double thickness portion 224 provided thereon and extending at right angles from portion 222. The folded portion 224 extends through an aperture 226 provided in the wall 18 of the housing and is adapted for external electrical connection thereto. The folded portion 224 of the arm 222 is received in a slot formed by spaced guide surfaces 228, 230 formed integrally with a raised portion indicated generally at 232 provided in the timer housing. The arrangement of FIG. 14 thus provides a unitary electrical connecting terminal and contact arm arrangement which is retained by simple sliding engagement with guide surfaces formed in the timer housing.

Figure 15:
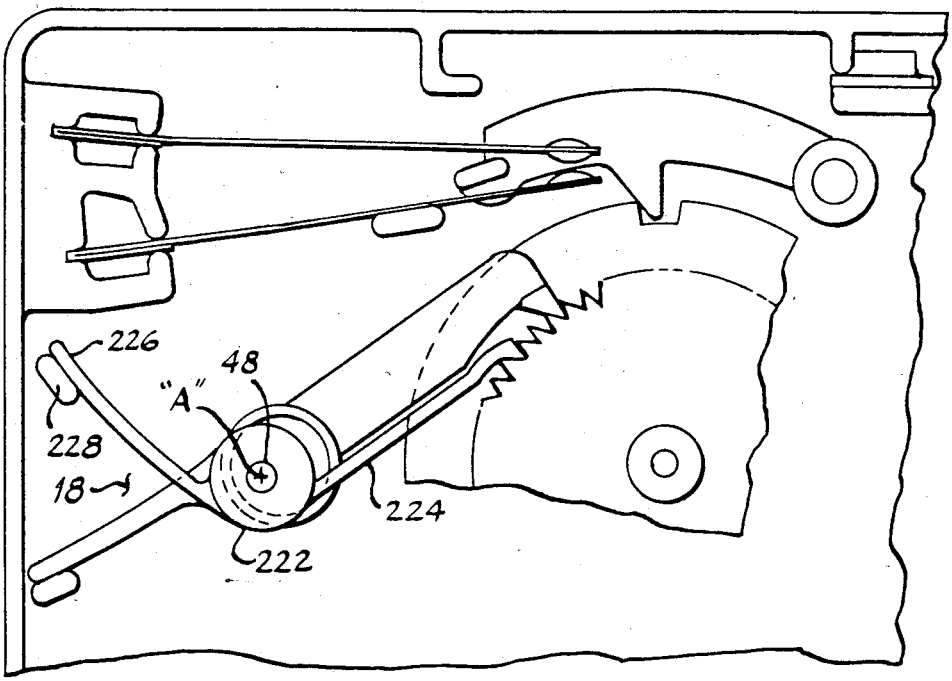
FIG. 15 is a portion of a plan view of an alternate arrangement of the embodiment of FIG. 1.

Referring now to FIG. 15, an alternate arrangement of the embodiment of FIG. 1 of the invention is shown wherein the antireverse member 222 is received on shaft 48 for pivotal movement about the center of rotation "A" of shaft 48. Member 222 has a pawl finger 224 which engages the ratchet 68 for preventing reverse rotation thereof by the appliance operator. Member 222 preferably has a resilient spring finger 226 provided integrally therewith which spring finger is registered against a lug 228 extending from the wall 18 of the housing. The spring finger 226 is preloaded to bias the pawl 224 into engagement with the ratchet 68. The arrangement of FIG. 15 thus provides a common pivot reference for the main drive pawl and the antireverse member.

The present invention thus provides a unique appliance programmer-timer having a motor and cam driven electrical switching mechanism assembled in a unitary housing. The programmer-timer of the present invention employs a stepping mechanism for advancing the electrical switching cams. The stepping mechanism employs an eccentric-driven advancement pawl for indexing a ratchet wherein the advancement pawl will accommodate reverse rotation of the driving eccentric without malfunction of the advance mechanism. The timer of the present invention employs a unique antireverse ratchet pawl having an integral bias spring for preventing reverse rotation of the programming cam by the appliance operator. Optional features of the programmer-timer of the present invention include an auxiliary subinterval cam provided on the shaft driving the eccentric for the advance pawl and an optional buzzer having a striker and anvil formed integrally with the motor stator plates. The present invention employs an optional drive pawl having integral bias spring finger formed therewith. An optional rotating printed circuit board-wiper arrangement is provided for the cam wheels for additional switching functions.

Although the invention has hereinabove been described in the presently preferred practice, it will be understood by those having skill in the art, that the invention is capable of modifications and variations all of which are deemed to be encompassed by the invention as defined by the following claims.

We claim:

1. A device for electrical switching in timed sequence comprising:

(a) a primary and secondary cam means rotatably mounted on a housing about respectively first and second spaced centers of rotation;

(b) electrical switch means including primary cam follower means responsive to movement of said primary cam means for effecting electrical switching of contacts in accordance with a first program sequence;

(c) secondary cam follower means responsive to said secondary cam means for altering said electrical switching in accordance with a second program sequence;

(d) ratchet and pawl means operative to cause rotation of said primary cam means and including a ratchet wheel rotatable about said first center and a drive pawl orbital about said second center; and, (e) drive means rotatable about said second center to cause said pawl to index said ratchet.

2. A device for switching in timed sequence comprising:

(a) primary cam means including a ratchet wheel rotatably mounted on a housing;

(b) primary cam follower means responsive to movement of said cam means and operative for effecting movement of one of a first set of electrical contacts;

(c) drive means for advancing said cam means said drive means including;

(i) a drive pawl pivotally mounted on said housing about a point spaced from the center of rotation of said cam means, said pawl contacting said ratchet wheel;

(ii) eccentric means rotatable for driving said pawl;

(iii) sub-interval cam means mounted on said housing means for rotation about a common center with said eccentric means;

(iv) motor means operative to rotate said sub-interval cam means and said eccentric means for effecting movement of said pawl for advancing said ratchet wheel;

(d) secondary cam follower means operative in response to rotation of said sub-interval cam means to effect sub-interval movement of one of said set of electrical contacts.

3. The device defined in claim 2, wherein:

(a) said primary cam follower means is operative to effect movement of one of a first set of electrical contacts; and, (b) said secondary cam follower means is operative to effect movement of one of a second set of electrical contacts.

4. The device defined in claim 2, wherein, said secondary cam follower means is operative to effect sub-interval opening and closing of said set of contacts and said primary cam follower means is operative to prevent movement of said contacts by said sub-interval cam follower means during a primary interval.

5. The device defined in claim 1, wherein said pawl makes an angle less than ten (10) degrees above the tangent to the ratchet point of contact by the pawl.

* * * * *